US008758561B2

(12) United States Patent
Dittrich et al.

(10) Patent No.: US 8,758,561 B2
(45) Date of Patent: Jun. 24, 2014

(54) CELLULOSIC MATERIAL

(75) Inventors: David John Dittrich, London (GB); Edward Dennis John, London (GB); Kevin McAdam, London (GB); Martin Coleman, London (GB); Robert John Whiffen, London (GB); Dominic Conrad Woodcock, London (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 13/811,249

(22) PCT Filed: Jul. 19, 2011

(86) PCT No.: PCT/GB2011/051352

§ 371 (c)(1),
(2), (4) Date: Apr. 18, 2013

(87) PCT Pub. No.: WO2012/010880

PCT Pub. Date: Jan. 26, 2012

(65) Prior Publication Data

US 2013/0284189 A1 Oct. 31, 2013

(30) Foreign Application Priority Data

Jul. 19, 2010 (GB) ..... 1012090.5

(51) Int. Cl.
*D21F 11/00* (2006.01)

(52) U.S. Cl.
USPC ..... 162/139; 131/351; 131/352; 131/313; 131/300

(58) Field of Classification Search
USPC ..... 162/139; 131/351, 352, 353, 354, 313, 131/300
See application file for complete search history.

(56) References Cited

U.S. PATENT DOCUMENTS

| | | | |
|---|---|---|---|
| 3,016,907 A | 1/1962 | Rosenberg et al. | |
| 3,550,598 A | 12/1970 | McGlumphy et al. | |
| 3,674,540 A | 7/1972 | Pergaminos | |
| 3,972,473 A | 8/1976 | Harrison | |
| 4,164,948 A | 8/1979 | Neringer | |
| 4,233,995 A | 11/1980 | Kotuby | |
| 4,253,473 A | 3/1981 | Marmo | |
| 4,517,990 A | 5/1985 | Boden | |
| 4,534,983 A | 8/1985 | Koehne | |
| 5,144,966 A | 9/1992 | Washington | |
| 5,221,502 A | 6/1993 | Washington | |
| 5,249,588 A | 10/1993 | Brown | |
| 5,778,899 A | 7/1998 | Saito et al. | |
| 5,860,428 A | 1/1999 | Lesser | |
| 6,289,897 B1 | 9/2001 | McAdam et al. | |
| 6,397,852 B1 | 6/2002 | McAdam | |
| 6,408,856 B1 | 6/2002 | McAdam | |
| 6,571,801 B1 | 6/2003 | Wuolukka | |
| 6,645,305 B2 | 11/2003 | Oliver | |
| 6,779,531 B1 | 8/2004 | Biggs et al. | |
| 2004/0045565 A1 | 3/2004 | Mua | |
| 2005/0000531 A1 | 1/2005 | Shi | |
| 2005/0034739 A1 | 2/2005 | Dittrich et al. | |
| 2005/0081869 A1 | 4/2005 | Biggs et al. | |
| 2005/0244521 A1 | 11/2005 | Strickland et al. | |
| 2006/0130862 A1 | 6/2006 | Dittrich et al. | |
| 2006/0283469 A1 | 12/2006 | Lipowicz | |
| 2007/0056600 A1 | 3/2007 | Coleman, III et al. | |
| 2007/0215168 A1 | 9/2007 | Banerjee et al. | |
| 2012/0160253 A1* | 6/2012 | Coleman et al. | 131/300 |

FOREIGN PATENT DOCUMENTS

| | | |
|---|---|---|
| CN | 1323317 A | 11/2001 |
| CN | 1456149 | 11/2003 |
| CN | 101128130 | 2/2008 |
| CN | 101129216 A | 2/2008 |
| DE | 2403836 B | 7/1975 |
| DE | 2515433 A1 | 11/1975 |
| DE | 2659611 A1 | 7/1977 |
| DE | 19949983 A1 | 5/2001 |
| EP | 135265 A2 | 3/1985 |
| EP | 135266 A2 | 3/1985 |
| EP | 135267 A2 | 3/1985 |
| EP | 196775 A1 | 10/1986 |
| EP | 272852 A1 | 10/1986 |
| EP | 0223454 A2 | 5/1987 |
| EP | 0464324 A2 | 1/1992 |
| EP | 0490559 A1 | 6/1992 |
| GB | 1284151 A | 8/1972 |
| GB | 1349537 A | 4/1974 |
| GB | 1502419 | 3/1978 |
| GB | 2266833 A | 11/1993 |
| JP | 53133697 A | 11/1978 |
| NL | 8203963 | 5/1984 |
| WO | 9732491 | 9/1997 |
| WO | 9815191 A1 | 4/1998 |
| WO | WO9857556 | 12/1998 |

(Continued)

OTHER PUBLICATIONS

International Search Report and Written Opinion, mailed Jan. 23, 2012, for PCT International Application No. PCT/GB2011/051352, filed Jul. 19, 2011.

International Preliminary Report on Patentability, mailed Jul. 4, 2012, for PCT International Application No. PCT/GB2011/051352, filed Jul. 19, 2011.

Observations and Questions for Flavor and Product Development: Ideas From the Conservative Treatment of Nose, Fauces, and Pharynx, 1984, Legacy Tobacco Documents Library, accessed via: legacy.library.ucsf.edu/tid/hfs46b00.

English Translation of Search Report, dated Mar. 22, 2013, for Chinese Patent Application No. 201080018931.4.

Search Report dated Nov. 19, 2009 for GB Patent Application No. 0907360.2, filed Apr. 29, 2009.

(Continued)

*Primary Examiner* — Mark Halpern
(74) *Attorney, Agent, or Firm* — N W Poulsen

(57) ABSTRACT

The present invention relates to a cellulosic material having one or more smoke diluents within its cellular structure and, optionally, one or more smoke diluents on its surface.

23 Claims, 4 Drawing Sheets

(56) References Cited

FOREIGN PATENT DOCUMENTS

Figure 1:
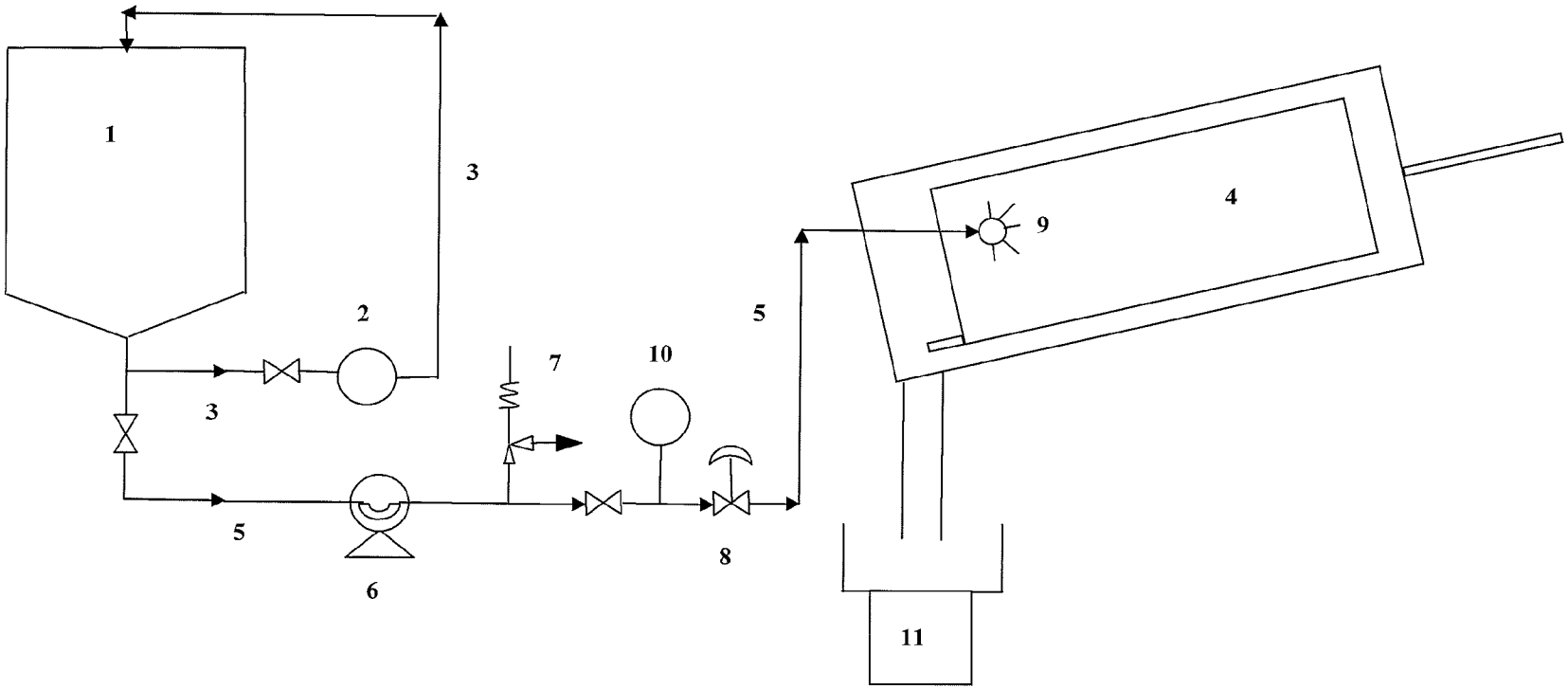

| | | | |
|---|---|---|---|
| WO | 0008062 | | 2/2000 |
| WO | WO03055486 | | 7/2003 |
| WO | WO03092416 | | 11/2003 |
| WO | 2005044026 | | 5/2005 |
| WO | 2007007269 | A2 | 1/2007 |
| WO | 2007012980 | A1 | 2/2007 |
| WO | WO2010/125387 | | 11/2010 |

OTHER PUBLICATIONS

International Search Report and Written Opinion, mailed Sep. 21, 2010, for PCT International Application No. PCT/GB2010/050692, filed Apr. 28, 2010.

International Preliminary Report on Patentability, mailed Jul. 5, 2011, for PCT International Application No. PCT/GB2010/050692, filed Apr. 28, 2010.

* cited by examiner

CELLULOSIC MATERIAL

CLAIM FOR PRIORITY

This application is a National Stage Entry entitled to and hereby claims priority under 35 U.S.C. §§365 and 371 to corresponding PCT Application No. PCT/GB2011/051352, filed Jul. 19, 2011, which in turn claims priority to GB application number 1012090.5, filed Jul. 19, 2010. The entire contents of the aforementioned applications are herein expressly incorporated by reference.

The present invention relates to cellulosic materials (such as tobacco) that comprise one or more smoke diluents, methods of preparing such cellulosic material, and uses thereof.

Combustible tobacco products or smoking articles, such as cigarettes, produce smoke in use generated from the incomplete combustion of tobacco and/or other filler materials. The term "mainstream smoke" refers to the mixture of gases, and particulate matter (aerosol) passing down the rod of smokeable material and issuing through the filter end. The mainstream smoke contains smoke that is drawn in through the lighted region of the smoking article, and typically contains components such as 'tar', nicotine and carbon monoxide (CO). Such components are known in the art as "smoke deliveries".

A number of strategies have been used in an attempt to lower smoke deliveries, such as improving the selective filtration of cigarette smoke.

Also, for example, it is known to include filler materials in the smokeable material of smoking articles such as cigarettes, in particular, non-combustible filler materials. Such filler materials include inorganic materials, such as dolomite, diatomaceous earth, calcium carbonate, magnesium oxide, and alumina; and organic materials such as starches, celluloses, pectins, and alginates or other materials known to those familiar with the art which may act as binders for filler materials.

However, a disadvantage of such fillet materials is that they can alter the smoke taste and flavour of the smoking article, which can be unacceptable to smokers.

It is known to include diluents in smoking articles such as cigarettes. Diluents are compounds that are vapourised during smoking and transfer to the mainstream smoke in aerosol form. They are generally selected such that they transfer to the smoke substantially intact. Other components of the smoke (tobacco-derived components in the case of tobacco-containing smoking articles) ate therefore "diluted" by this means.

Such smoke diluents can be included in solid form, such as a powder, which is simply mixed with the cellulosic material or fillet material. However, such powders are easily lost during subsequent processing to create a smoking article.

Alternatively, the smoke diluents may be added in the form of a liquid or gel, which is sprayed onto, or mixed with the cellulosic or filler material, or in which the cellulosic or filler material is otherwise coated, such that an amount of diluent remains on the material after drying. The smoke diluent may be incorporated with a volatile liquid, such as an appropriate solvent, and sprayed onto the filler or tobacco material. The solvent is expected to evaporate, leaving the smoke diluent on the surfaces of the tobacco or filler material.

However, these methods may result in only a surface covering of diluent on the target material. The resultant presence of the smoke diluent on the surface of the cellulosic material or filler material can be adversely affected during subsequent processing to create a smoking article. A further problem associated with including a diluent in this way is that it can affect the surface properties of the cellulosic material, for example making it sticky which has a seriously adverse effect on the processing of the material, in particular as it will have a tendency to clump and will not flow.

It is desirable to maximise the amount of smoke diluent that may be included in the smokeable material for inclusion in smoking articles. It is also desirable to add the smoke diluent in such a way that it does not present problems associated with processing the smokeable material.

By the term "processing" is meant any aspect of a method known by one skilled in the art to be used in the manufacture of a combustible tobacco product. For example, blending, and cutting of the cellulosic material and manufacture of smoking articles.

It is desirable to provide cellulosic material which comprises an increased amount of a smoke diluent in comparison to known comparable cellulosic material without unduly adversely affecting other properties of the material, and products in which it is used. For example, the constituent materials of the smokeable material of a smoking article are ideally free-flowing, with minimal stickiness. This allows for easy handling and processing of the materials. Further to this, it is desirable that the addition of a smoke diluent, and the presence of a smoke diluent in or on the cellulosic material does not significantly or adversely affect the flavour and taste of a smoking article.

One advantage of the present invention is that it may provide a smokeable material comprising cellulosic material incorporating smoke diluent(s), which also retains the desirable features of the smokeable material.

A further advantage of the present invention is that it may provide a method for providing cellulosic material incorporating smoke diluent(s) at a range of inclusion levels to facilitate flexibility in smoke dilution potential optimisation.

According to a first aspect of the present invention, there is provided cellulosic material to which a smoke diluent has been added, at least some of the smoke diluent being retained within the cellular structure of the cellulosic material, the smoke diluent being retained in and, optionally, on the cellulosic material in an amount of greater than or equal to 5% based on the dried weight of the cellulosic material.

According to a second aspect, a method of preparing the cellulosic material according to the first aspect of the invention is provided.

According to a third aspect of the present invention, there is provided a smoking article comprising a cellulosic material according to the first aspect of the present invention, and/or prepared by a method according to the second aspect of the present invention.

According to a fourth aspect of the present invention, there is provided a method of producing a smoking article comprising admixing a cellulosic material according to the first aspect with one or more other cellulosic materials, and/or other smoking article constituents.

According to a fifth aspect of the present invention, there is provided a use of a cellulosic material according to the first aspect of the present invention in the manufacture of a smoking article.

It will be appreciated by one skilled in the art that a balance must be struck between including the smoke diluent in the cellulosic material in an amount sufficient to achieve the desired reduction in smoke deliveries, and providing cellulosic material that can be used, without a problem, in typical manufacturing equipment for smoking articles, i.e. the cellulosic material which is sufficiently free-flowing that it does not stick to or otherwise inhibit cigarette making machinery. Striking this balance is made easier by the present invention, as it allows more diluent to be included in the treated cellulosic material without the surface of the cellulosic material being affected to such an extent that it causes the unwanted stickiness and clumping.

The phrase "cellulosic material" as used herein means any material comprising cellulose. The material may be a tobacco material, for example, stem, lamina, dust, reconstituted tobacco, or a mixture thereof. Suitable tobacco materials include the following types: Virginia or flue-cured tobacco, Burley tobacco, Oriental tobacco, or a blend of tobacco materials. The tobacco may be expanded, such as dry-ice expanded tobacco (DIET), or processed by any other means such as extrusion. The stem tobacco may be pre-processed or unprocessed, and may be, for instance, solid stems (SS); shredded dried stems (SDS); steam treated stems (STS); or any combination thereof. Preferably, tobacco with an open-pore structure is used as a diluent carrier.

The phrase "within the cellular structure" as used herein means that the smoke diluent is located in or within the cell wall of cells of the cellulosic material, or between adjacent cells of the cellulosic material. The term "retained" indicates that at least some of the smoke diluent remains within the cellular structure of the cellulosic material and adhered to the surface of the cellulosic material throughout typical processing conditions which cellulosic materials that are to be included in a smoking article undergo, such as blending and incorporation into a rod of smokeable material. Without being bound by theory, location of the smoke diluent in the cellular structure of the cellulosic material facilitates 'free flow' and lower clumping propensity in the impregnated materials.

In certain embodiments, the weight of said smoke diluent retained within the cellular structure of the cellulosic material, and, optionally, on the surface of the cellulosic material, is greater than or equal to 5%, 10%, 15%, 20%, 25%, 30%, 35%, 40%, 45% or 50% based on the dried weight of the cellulosic material.

In certain embodiments, the cellulosic material is SDS.

In alternative embodiments, the cellulosic material is cut lamina or DIET. DIET undergoes processing which causes the expansion of the tobacco cell structure. This has the advantage that it may allow more diluent to be retained within its cellular structure, and/or it can facilitate the penetration of the diluent into the cellular structure.

Preferably, the cellulosic material has a moisture level suitable for use with conventional smoking article processing equipment. In addition, the cellulosic material preferably is of a consistency suitable for use with typical smoking article manufacturing equipment. For example, the cellulosic material is preferably free-flowing, and does not stick to the cigarette making machinery, impeding manufacture.

A suitable moisture level of the cellulosic material to be used with such equipment is less than about 20%. Thus, preferably, the cellulosic material of the present invention includes no more than 20% moisture, more preferably the moisture level of the cellulosic material is no more than about 18%, no more than about 15% or no more than about 12%.

The terms "smoke diluent" and "diluent" as used herein mean a material for incorporation into a smoking article which serves to reduce the smoke deliveries when the smokeable material is combusted and the smoking article is consumed. The smoke diluents are suitable for incorporation into the smokeable material of a smoking article.

The diluent is at least one aerosol forming agent which may be, for instance, a polyol aerosol generator, or a non-polyol aerosol generator, preferably a non-polyol aerosol generator. It may be a solid or liquid at room temperature, but preferably is a liquid at room temperature. Suitable polyols include sorbitol, glycerol, and glycols like propylene glycol or triethylene glycol. Suitable non-polyols include monohydric alcohols, high boiling point hydrocarbons, acids such as lactic acid, and esters such as diacetin, triacetin, triethyl citrate or isopropyl myristate.

Preferably the smoke diluent has a melting point of less than about 110, 105, 100, 95, 90, or 85° C.

In the present invention, the smoke diluent is preferably glycerol, triacetin, triethyl citrate or isopropyl myristate.

A combination of diluents may be used, in equal or differing proportions.

Some of these substances are known to be included in combustible tobacco products for other purposes other than as a smoke diluent. For example, triacetin and diacetin have been previously used in smoking articles as non-polyol aerosol generators (WO 98/57556). TEGDA, triacetin and glycerol are known plasticizers. Glycerol is commonly used as a humectant in tobacco because it is capable of improving the hygroscopic and mechanical properties of tobacco. In U.S. Pat. No. 6,571,801, tobacco was loaded with humectants such as glycerol, propylene glycol, sorbitol or diethylene glycol in the range 4-15%. Glycerol has been used as an aerosol generating material in a smoking article, in the range of 5-20% by weight of the sheet material (see, for example, WO 03/092416). Glycerol has also been used to improve smoke filtration (U.S. Pat. No. 3,674,540; U.S. Pat. No. 5,860,428; U.S. Pat. No. 6,397,852).

The smoke diluent may be present in the cellulosic material according to the invention in the form of a solid or a liquid at ambient room temperature.

In some embodiments, the smoke diluent is a substantially water soluble material. In alternative embodiments, the smoke diluent is a water insoluble or water sparingly soluble material. In yet other embodiments, the diluent may be soluble in non-aqueous solvents.

Conventional methods for adding a diluent to cellulosic material may result in the diluent becoming coated on the surface of the cellulosic material. In contrast, the present invention provides methods which result in at least some of the smoke diluent penetrating the cellular structure of the cellulosic material.

In preferred embodiments, location of the smoke diluent within the cellular structure of the cellulosic material, and, optionally, on the surface of the cellulosic material is achieved by an impregnation process which preferably facilitates the penetration of the diluent into the cellular structure.

The methods according to the present invention comprise the use of certain conditions before, during, or after application of the smoke diluent to the cellulosic material, and/or the use of one or more vehicles with which the diluent is applied to the cellulosic material.

In some embodiments, the methods involve subjecting the cellulosic material to one or more treatment steps before or during application of the smoke diluent. These treatment steps are intended to enhance penetration of the diluent into the cellulosic material when the diluent is applied. For example, the cellulosic material may be subjected to one or more treatments that can dry and/or expel air which is present in the material. The cellulosic material may be treated so as to rupture at least some of the cells, thereby providing a means by which the diluent, when applied, may gain access to the cell interior which may otherwise be sealed.

The treatment steps that dry and/or remove the air from the cellulosic material include heat treatment, vacuum treatment, liquid impregnation, steam treatment, pressurised liquid impregnation, vacuum freeze drying and the use of supercritical fluids.

Heat treatment involves heating the cellulosic material to bone dryness. This treatment step also results in cell air expulsion via expansion.

Vacuum treatment involves applying a vacuum to expel air from the cellulosic material.

Liquid impregnation involves either applying hot liquid to cold cellulosic material, or cold liquid to hot cellulosic material, in order to soften cell walls and promote removal of cell air via liquid infusion. The difference in temperature between the liquid and the material may be at least 30, 40, 50, 60, 70, 80, 90, or 100° C., or above.

Pressurised liquid impregnation involves either applying hot liquid to cold cellulosic material, or cold liquid to hot cellulosic material, under pressure. This treatment may also include a vacuum pre-treatment stage prior to pressure impregnation, followed by vacuum drying of impregnated material until the desired moisture level has been reached. Cell air is removed by forced liquid infusion.

Steam treatment involves the application of steam to soften the cell walls of the cellulosic material and removal of cell air via steam infusion.

Vacuum freeze drying may be used to dry cellulosic material to bone dryness and remove air from cells.

Air may also be removed from the cells of the cellulosic material by infusion with supercritical fluids (e.g. $CO_2$) followed by expansion.

In preferred embodiments, the methods of the present invention involve the use of at least two treatments steps.

In preferred embodiments, the method involves subjecting the cellulosic material to a treatment step, which has the combined function of drying the cellulosic material, and partial cell air expulsion.

It is suggested that treatment of cellulosic material facilitates smoke diluent penetration into the cellular structure of the cellulosic material as a result of the combined effect of drying of the cellulosic material, and partial cell air expulsion resulting from the drying process. Application of smoke diluent in the form of a solution or suspension results in entry of the smoke diluent into the dried cellulosic cells as a result of the capillary wetting process of cell walls.

Subjecting the cellulosic material to a treatment step involving heating is preferred in some embodiments of the invention. It is suggested that further drawing of smoke diluent into heat-treated cells may occur as the air within the cells contracts during cooling following heat treatment.

The methods of the present invention may also be applied to cellulosic starting material which is pre-treated cellulosic material, such as cut lamina, cut blend, SDS, STS or DIET. When using such cellulosic material, the method preferably includes a treatment step involving the heating of the pre-treated cellulosic material, in order to enhance penetration or impregnation of the smoke diluent into the cellular structure of the cellulosic material.

In embodiments of the present invention involving heat treatment, the cellulosic material is preferably treated for at least about 5 minutes, preferably at least about 10 minutes, preferably at least about 20 minutes, preferably at least about 30 minutes, and most preferably about 30-45 minutes.

In embodiments of the present invention involving heat treatment, the heat treatment step may be carried out under pressure. Materials may also be subjected to steam and/or vacuum treatment. Heat, steam, vacuum and/or pressure may be individually or sequentially applied. The most suitable process combination may be dependent on the particular starting material used and may involve an empirical iterative approach.

If the heat treatment is not pressurised, the temperature used may be at least about 90° C., preferably about 100° C., more preferably about 105-110° C.

The methods according to the present invention further include a step of applying the smoke diluent to the cellulosic material. In some cases, liquid smoke diluents may be applied directly to the cellulosic material.

In some embodiments, the smoke diluent is applied in the form of a solution, an emulsion or a suspension. In order to prepare these, the smoke diluent is mixed with one or more vehicles. Suitable vehicles include water; organic solvents such as alcohols, hydrocarbons or other appropriate organic based solvents; liquids or gases such as carbon dioxide (which may be supercritical); or other suitable agents or vehicles capable of forming a solution, emulsion, or suspension of the smoke diluent. Suitable vehicles include water; alcohols, such as methanol and ethanol; liquid or gaseous carbon dioxide. The choice of vehicle is preferably compatible with tobacco processing technology. The use of an aqueous vehicle is particularly preferred as it avoids the use of large volumes of flammable solvents.

The vehicle may be a solvent, in that one or more of the smoke diluents may be soluble in the vehicle. Where more than one smoke diluent is used, the vehicle may be a solvent for one or more of the diluents.

In some embodiments, the vehicle is able to penetrate the cellular wall of the cellulosic material.

The vehicle may be an agent which has drying properties, in that it is volatile below or around temperatures such as those used when the smoke diluent is applied to the cellulosic material.

It is suggested that one way in which the use of a vehicle may facilitate smoke diluent penetration into the cellular structure of the cellulosic material is by aiding removal of residual moisture from within the cell wall of the cellulosic material, and/or facilitating entry of the smoke diluent into the cell.

When the vehicle is a liquid, the smoke diluent may be in solution, suspension or provided as an emulsion with the vehicle. In preferred embodiments, the smoke diluent is in the form of a solution or emulsion. In some embodiments, the smoke diluent may be in the form of an aqueous solution or emulsion.

In some embodiments, the smoke diluent is in the form of a solution rather than a suspension. This is preferred, as the application of a suspension may result in greater surface deposition of the smoke diluent on the cellulosic material rather than entry into the cellular structure.

A high shear mixer may be used to prepare the smoke diluent and/or any vehicle for application to the cellulosic material. Such processing typically generates very small droplets of diluent and/or vehicle.

It is suggested that processing in this way may enhance the penetration efficiency of the diluent into the cellular structure of the cellulosic material, as a result of the small droplet size of the diluent. This may particularly be the case where the smoke diluent is a water sparingly soluble or insoluble liquid which is mixed with water to form an aqueous emulsion.

Emulsions of smoke diluents according to the present invention should remain stable, in that the diluent should not undergo a chemical change during preparation of the emulsion and application to the cellulosic material. In some embodiments this may be achieved by continuous high shear mixing of the emulsion prior to or during the application process, and/or by the addition of selected emulsifying agents.

The solubility of emulsions according to the present invention may be enhanced by known means such as, for example, conventional heated emulsion technology.

The composition of the smoke diluents incorporated into or provided with one of mote vehicles can be calculated so that the cellulosic material that results from addition of the emulsion to the cellulosic material comprises the desired level of diluent (based on the starting dry weight of the cellulosic material) and moisture level.

Application of the smoke diluent to cellulosic material may be carried out by soaking and/or mixing the cellulosic material in an excess of smoke diluent, followed by filtering of excess diluent; saturating the cellulosic material with the required level of smoke diluent; spraying the cellulosic material with a smoke diluent and/or pressurised spraying of the cellulosic material with a smoke diluent. Refluxing the materials with diluent in the vehicle followed by evaporative methods to remove the vehicle e.g. vacuum evaporation technology, may also be used.

In embodiments according to the second aspect of the present invention involving heating of the cellulosic material, the smoke diluent is preferably contacted with the cellulosic material whilst the cellulosic material is hot.

Application of the smoke diluent to cellulosic material may be carried out at elevated temperatures. For example, at temperatures greater than around 60° C., 70° C., 80° C., 90° C., 100° C., 105° C., or 110° C., In embodiments wherein the cellulosic material and smoke diluent are mixed, the mixing is preferably gentle, to prevent cellulosic material site degradation. For example, an orbital mixer may be used.

In embodiments wherein the cellulosic material is sprayed with a smoke diluent, the method may involve optimised consistent spraying of diluent onto a curtain of cellulosic material. The application rate may be consistent in order to provide a consistent target diluent loading and provide a consistent moisture level for the cellulosic material. In addition, it may be advantageous to have one or mote of an optimal surface area for the cellulosic material (for example by having an almost separate tumbling of small fragments of cellulosic material); a consistent flow of cellulosic material; and a cooling stage after the spraying stage and/or a bulking time after the spraying stage. Conventional spray and/or pumping technology may be used to achieve the spraying discussed herein.

In some embodiments, the cellulosic material (preferably whilst hot) is soaked or admixed in an excess of smoke diluent (preferably in the form of an aqueous solution or emulsion).

In a preferred embodiment, a diluent delivery system according to the second aspect of the present invention involves subjecting the cellulosic material to a treatment such as heat treatment, vacuum treatment, liquid impregnation, steam treatment, or vacuum freeze drying, before and/or during treating the cellulosic material with smoke diluent. Preferably, the diluent delivery system involves subjecting the cellulosic material to a heat treatment, followed by soaking and/or spraying the cellulosic material with smoke diluent.

The cellulosic material is then dried to a suitable moisture level, and may, optionally, be sieved.

Cellulosic material according to the present invention may then be used in the preparation of a smoking article.

According to the present invention, there is provided a smoking article comprising a cellulosic material according to the first aspect of the present invention, and/or prepared by a method according to the second aspect of the present invention.

In preferred embodiments, the cellulosic material comprising the smoke diluent undergoes minimal processing prior to incorporation into a smoking article.

By the term "processing" is meant any aspect of a method known by one skilled in the art to be used in the manufacture of a combustible tobacco product, for example, blending, and cutting of the cellulosic material and manufacture of smoking articles.

Preferably, the smoking article comprises a cigarette.

In preferred embodiments, the smoking article includes a smokeable filler material comprising at least 5%, at least 10%, at least 20%, at least 30% or at least 35% at least 40% or at least 45% or at least 50% by weight smoke diluent.

According to the present invention, methods are provided of producing a smoking article comprising admixing a cellulosic material of the present invention with one or more other cellulosic materials, and/or other smoking article constituents.

In yet a further aspect there is provided a use of a cellulosic material of the present invention in the manufacture of a smoking article.

Figure 2:
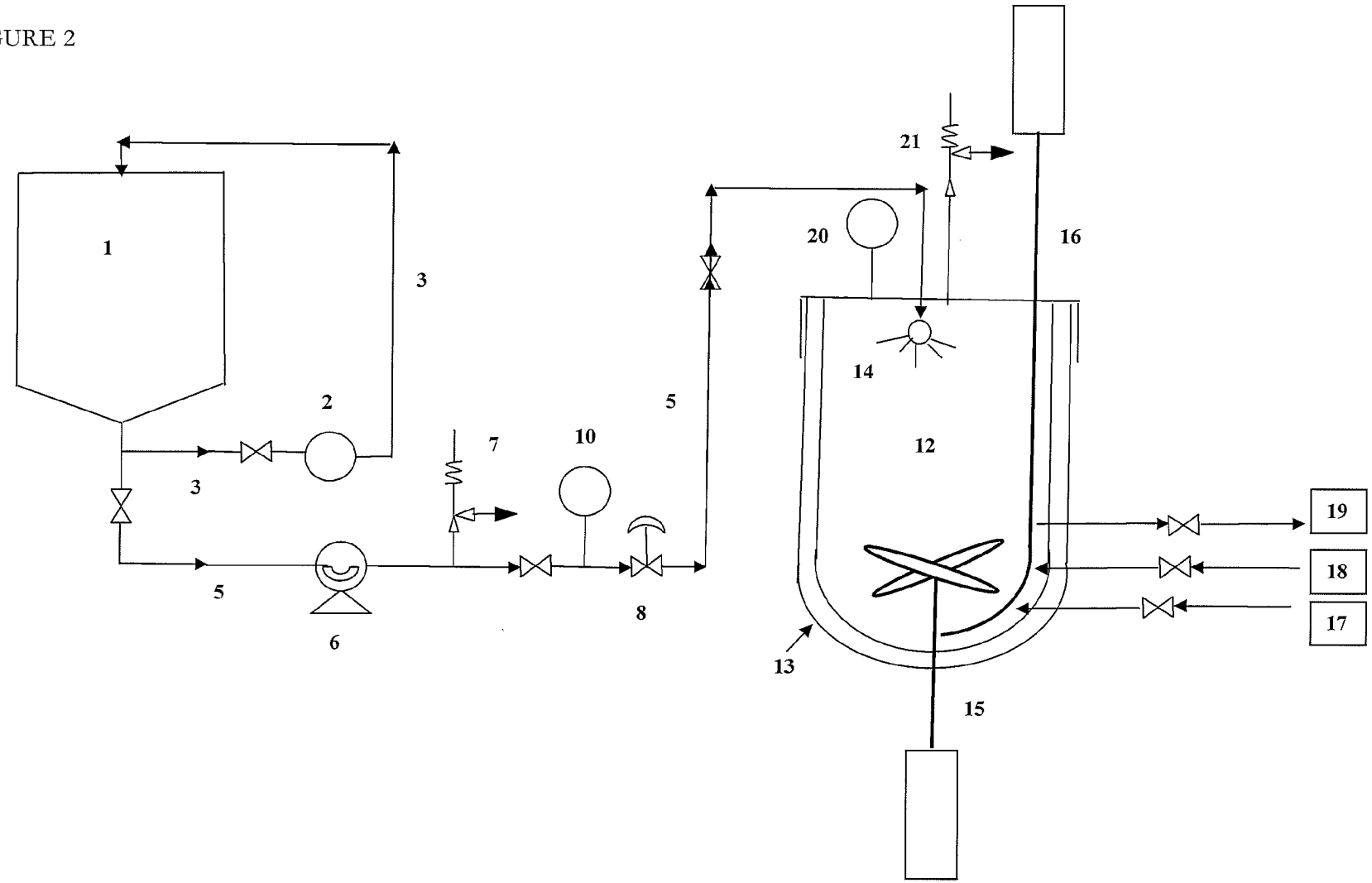
Figure 3A:
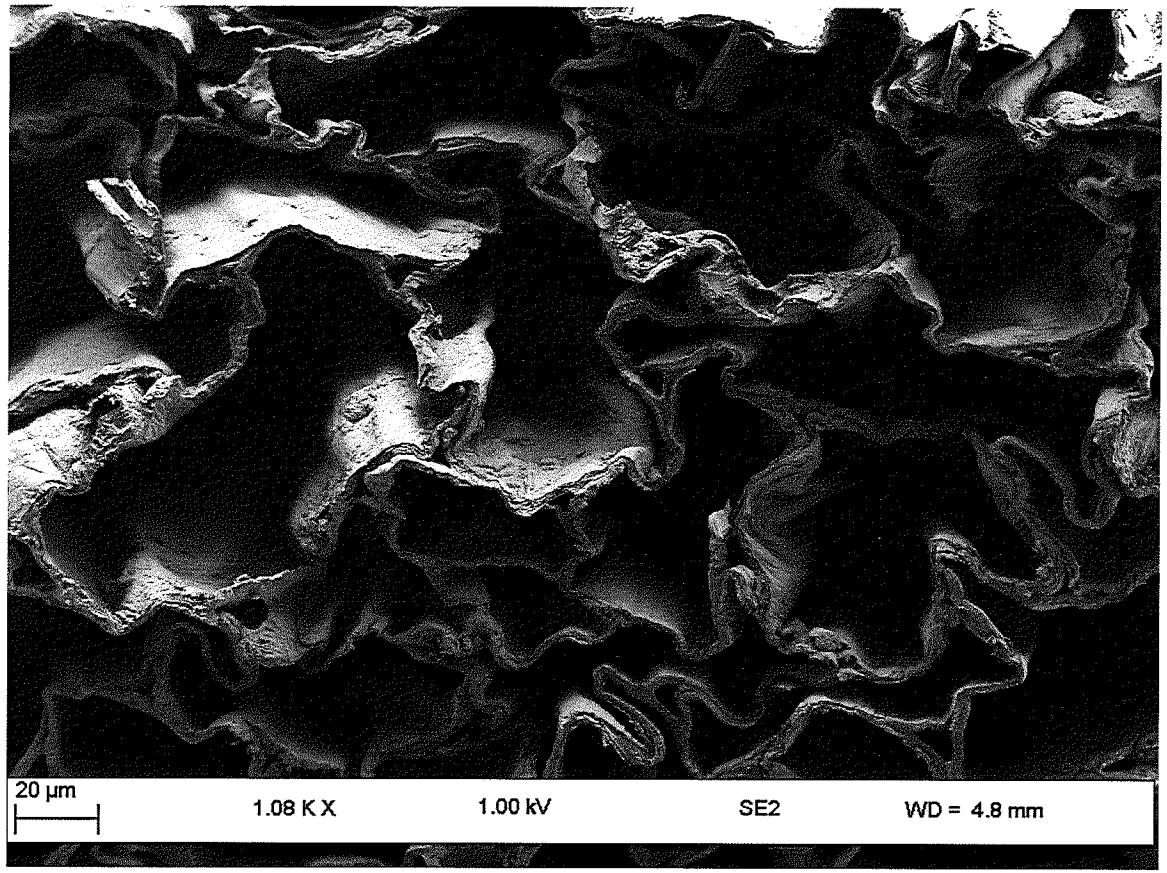
Figure 3B:
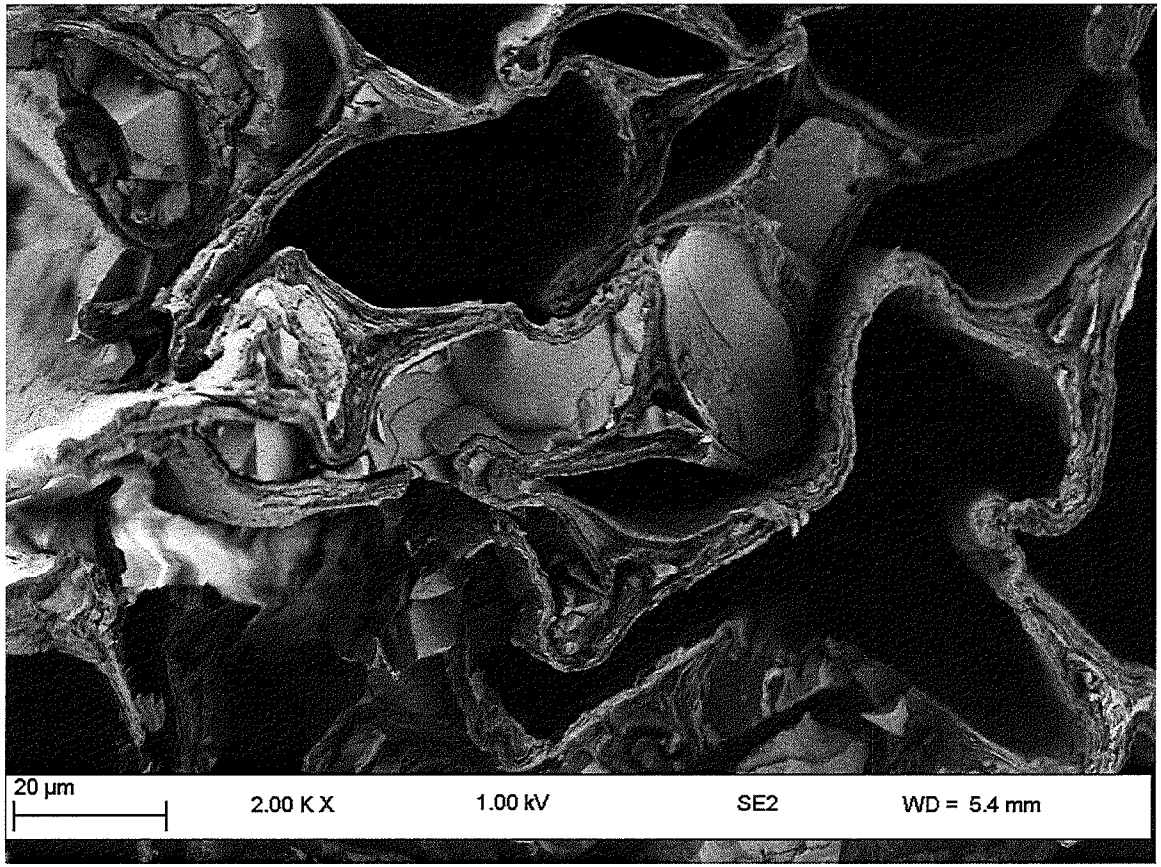

The present invention will now be described by way of example, in which reference is made to the following figures:

FIG. 1 which illustrates a schematic for one embodiment of a continuous spray flow through inclined rotary cylindrical drum dryer method;

FIG. 2 which illustrates a schematic for applying heat, steam, vacuum and/or pressure in suitable combination or sequentially whilst agitating the cellulosic materials in a batch mixing method;

FIG. 3A shows a Cryo-Scanning Electron Microscope (Cryo-SEM) image showing the cellular structure of cellulosic material FIG. 3B shows a Cryo-SEM image showing the cellular structure of cellulosic material following impregnation with a diluent, according to the invention.

In this respect, FIG. 1, which illustrates a continuous spray flow through method, shows a holding vessel 1, which may be used to hold the smoke diluent or an aqueous solution or emulsion thereof. The holding vessel may be in fluid communication with a high shear mixer 2, such as a Silverson inline mixer, by means of connecting lines 3, such that an aqueous solution and/or emulsion may be maintained by recycling the contents of the holding vessel through the high shear mixer 2.

Dried cellulosic material (such as SDS with a moisture level of 6-7%) is heated as it passes through a dryer 4 (such as flow through inclined rotary cylindrical drum dryer) causing the air within the cells to expand. The dryer 4 may be in fluid communication with the holding vessel by means of a spray system which may comprise connecting lines 5, a pump 6, a safety relief valve 7, a pinch valve 8, a spraying means 9, and a pressure gauge 10. Preferably the spraying means (such as a nozzle or spray head) is near the exit of the dryer.

As the cylinder dryer 4 rotates, an aqueous solution or emulsion of smoke diluent is sprayed at an appropriate, preferably consistent, rate via the spraying means 9 onto a falling curtain of hot cellulosic material just prior to the cellulosic material exiting the dryer 4 onto a conveyor 11.

The conveyed cellulosic material may be bulked for a period (for example, about at least 12 hours) during which the cellulosic material cools. The cooled cellulosic material may, optionally, be dried to a moisture level acceptable for blending and cigarette manufacture.

The term "bulked" as used herein is a conventional term in the art of smoking article manufacture, and refers to the step of increasing the level of moisture in the cellulosic material.

FIG. 2 shows a batch mixing process by which an emulsion is emulsified or mixed by means of a high shear mixer.

The holding vessel containing the smoke diluent or an aqueous solution or emulsion thereof and fluid delivery to the spray system is similar to that described in respect of FIG. 1. In particular, components 1, 2, 3, 5, 6, 7, 8, and 10 are the same as shown in respect of FIG. 1.

In addition, the apparatus is in fluid communication with a mixing vessel 12, by means of a spraying system 14. The vessel 12 may be heated, for example by a steam heated jacket 13. Cellulosic material within vessel 12 is agitated, for example via a stirring means 15, and or a wall-scraping action 16, and these agitation means may operate independently.

An aqueous solution or emulsion of smoke diluent is sprayed onto the cellulosic material which is agitated via the stirring means. The mixing vessel 12 may comprise a means 17 by which steam may be injected into the vessel, by which the vessel may be pressurised 18, or depressurised 19. The mixing vessel may be equipped with a pressure gauge 20 and a safety relief valve 21.

EXAMPLES

Example 1

Impregnation of Diluent Using an Orbital Mixer

Shredded dried stem tobacco (SDS) was impregnated with different diluents according to the following procedure, and the level of impregnation assessed.

SDS was dried in an oven at between 105 and 110° C. for around 30-45 minutes, until the tobacco was 'bone dry'.

An aqueous solution (or emulsion) of smoke diluent was prepared using a Silverson high shear mixer, and this solution or emulsion was added to the hot SDS. The SDS and smoke diluent solution (or emulsion) was then mixed using an orbital mixer, and allowed to cool.

The mixture was then dried in a foil-lined tray at 22° C. and 60% relative humidity, for around 12 hrs. In some cases, where required, the mixture was further dried, in air, at room temperature.

In some cases, where required, the cellulosic material was gently sieved using a coarse sieve.

The resultant materials were found be free-flowing and not sticky.

The level of impregnation of SDS with different smoke diluents is shown in Table 1, Target levels of impregnation are shown, with actual levels of diluent impregnation given in parentheses for comparison.

It was found that the dried SDS absorbs up to 70% liquid by weight without excessive draining or 'puddling'.

TABLE 1

| | Target % Diluent in Final Material | | | | |
|---|---|---|---|---|---|
| | 10-19% | 20-29% | 30-39% | 40-49% | 50-59% |
| Triacetin | | 20 (19) | 30 (30)<br>30 (29)<br>36 (38) | 40 (41) | 50 (49)<br>50 (54) |
| Isopropyl myristate | | 20 (18) | | | |
| Triethyl citrate | 10 (9) | 20 (19) | 30 (30) | 40 (41) | 50 (55) |
| Triacetin/ Glycerol mixture | | 17 (17) triacetin 3 (4) glycerol | 27 (25) triacetin 3 (3) glycerol | | |

Blends of the impregnated SDS material and lamina were then prepared in which the SDS and lamina were present in equal amounts.

The different blends were found to have a wide range of diluent levels, and these are summarised in Table 2.

All of the blends were found to be free flowing and not sticky and were suitable for use in conventional cigarette making machinery.

TABLE 2

| Diluent | % Diluent in Blend |
|---|---|
| Triacetin | 12-23 |
| Triethyl citrate | 5-21 |
| Isopropyl myristate | 4-23 |

Example 2

Impregnation of Diluent Using a Continuous Spray, Flow Through Inclined Rotary Cylindrical Drum Dryer Process Shredded dried stem tobacco (SDS) was impregnated with triacetin according to the following procedure, which is shown in FIG. 1, and the level of diluent in cigarettes containing the impregnated tobacco was assessed.

SDS was dried to around 6% moisture using a flow through inclined rotary drum dryer, in accordance with conventional procedures employed in tobacco drying.

In a second treatment, a triacetin/water emulsion was sprayed onto a falling hot curtain of the pre-dried SDS utilising a flow through inclined rotary drum dryer modified to include a continuous spray system near the material exit point.

The exiting material, having the desired diluent impregnation level and water content (typically 18%) was then collected and bulked.

The material was dried to the required finished moisture content (typically 13%) via further rotary drum drying. The resulting material was free flowing and not sticky and could be blended satisfactorily with other tobaccos at the required ratios via conventional tobacco processing methods.

Cigarettes were manufactured utilising a blend of 50% lamina and 50% impregnated SDS (Table 3—TEST cigarette).

The measured SDS impregnation level was 20% triacetin. The triacetin level measured in the final blend was 7% (the reduction in diluent level could be attributed to process losses).

The smoke chemistry of the cigarettes is shown in Table 3 (TPM, Total Particulate Matter; NFDPM, Nicotine-Free Dry Particulate Matter). Cigarettes were manufactured utilising conventional cigarette manufacturing methods and machinery. Control cigarettes were manufactured using a lamina blend. All cigarettes were manufactured using the same paper and filter specifications.

TABLE 3

| Sample Cigarette | TPM (mg/cig) | Water (mg/cig) | Nicotine (mg/cig) | NFDPM (mg/cig) | Puff No | CO (mg/cig) | Triacetin (mg/cig) | Smoke Dilution % |
|---|---|---|---|---|---|---|---|---|
| CONTROL | 8.6 | 0.48 | 0.76 | 7.4 | 8.2 | 6.5 | 0.16 | 2.2 |
| TEST | 7.6 | 0.32 | 0.29 | 7.0 | 6.2 | 5.1 | 2.90 | 41.4 |

The smoke dilution was calculated as follows:

[triacetin in smoke (mg/cigarette)/NFDPM (mg/cigarette)]×100

Cigarette filters commonly have triacetin added as a 'plasticiser' to increase the firmness of the filter. The observed dilution in the control cigarette was thought to be due to the transfer of filter triacetin to smoke.

The data shown in Table 3 clearly indicate that triacetin impregnated SDS incorporated in the tobacco blend acts as an efficient smoke dilution material, transferring substantial quantities of triacetin into smoke.

Example 3

Impregnation of Diluent Using a Batch Mixing Process

Shredded dried stem tobacco (SDS) was impregnated with triacetin according to the following procedure, which is shown in FIG. 2, and cryo-Scanning Electron Micrographs were produced of the material following impregnation with the diluent. The level of diluent in cigarettes containing the impregnated tobacco was also assessed.

2 kg of SDS was placed in a mixing vessel equipped with scrape wall mixing baffle, stirrer, heating jacket, steam injection, pressure and vacuum capability. The mixing baffle was activated and continued to operate continuously throughout the procedure. The SDS moisture was raised to approximately 35% by steam injection. At the same time, the temperature of the mixer jacket was raised to 70° C.

860 g of triacetin was emulsified in 400 g water in a separate vessel for at least 90 seconds.

The triacetin emulsion was then added into the mixer over a period of 70 seconds. The SDS was subsequently mixed for 3 minutes and dried to suitable moisture by increasing the mixing vessel jacket temperature to 94° C. and engaging the vacuum pump at 450 mbar for 37 minutes.

The target triacetin impregnation level was 30%, and the measured level was 33%.

The resultant material was found be free-flowing and not sticky.

Cryo-Scanning Electron Microscopy images of the tobacco material before and after triacetin incorporation are shown in FIGS. 3A & 3B. FIG. 3A shows the unprocessed control SDS, and the cell structure can be seen to be devoid of material. In contrast, FIG. 3B clearly indicates the presence of triacetin within the cell structure.

The smoke dilution capacity of the SDS material impregnated with triacetin in accordance with the described method was assessed.

Cigarettes were manufactured utilising a blend of 50% lamina and 50% impregnated SDS. The target impregnation level SDS with triacetin was 20%, and the measured impregnation level was 21%. The triacetin level measured in the final blend was 8% the reduction in diluent level could be attributed to process losses).

The smoke chemistry of the cigarettes is shown in Table 4. Cigarettes were manufactured utilising conventional cigarette manufacturing methods and machinery. REFERENCE cigarettes were manufactured using a lamina blend, SDS BLEND CONTROL cigarettes comprised 50% lamina and 50% non impregnated SDS, and TEST Cigarettes were manufactured utilising a blend of 50% lamina and 50% impregnated SDS as described above. All cigarettes were manufactured using the same paper and filter specifications.

TABLE 4

| Sample Cigarette | TPM (mg/cig) | Water (mg/cig) | Nicotine (mg/cig) | NFDPM (mg/cig) | Puff No | CO (mg/cig) | Triacetin (mg/cig) | Smoke Dilution % |
|---|---|---|---|---|---|---|---|---|
| REFERENCE | 6.8 | 0.38 | 0.61 | 5.8 | 7.0 | 5.1 | 0.19 | 3.3 |
| SDS BLEND CONTROL | 5.6*(5.64) | 0.58 | 0.40 | 4.7*(4.66) | 7.2 | 5.8 | 0.21 | 4.5 |
| TEST | 5.4 | 0.18 | 0.21 | 5.0 | 7.4 | 3.7 | 2.43 | 48.6 |

(*rounded to 1 decimal place)

The data shown in Table 4 clearly indicate that triacetin impregnated SDS incorporated in the tobacco blend acts as an efficient smoke dilution material, transferring substantial quantities of triacetin into smoke.

The invention claimed is:

1. A diluent-impregnated cellulosic material having comprising at least one added smoke diluent retained within the cellulosic material cellular structure and, optionally, also on its surface, wherein the weight of said smoke diluent is greater than or equal to 5% based on the dried weight of the cellulosic material.

2. The cellulosic material of claim 1, wherein said cellulosic material has a moisture level which is less than about 20%.

3. The cellulosic material of claim 1, wherein said cellulosic material is a tobacco material.

4. The cellulosic material of claim 3, wherein the diluent is retained within the cellular structure of the tobacco material when used in a tobacco product.

5. The cellulosic material of claim 3, wherein the diluent is retained on the surface of the tobacco material when used in a tobacco product.

6. The cellulosic material of claim 3, wherein said tobacco material is at least one of solid stems, shredded dried stems, steam treated stems, cut lamina, stalks, DIET, reconstituted tobacco, cut blend, and mixtures thereof.

7. The cellulosic material of claim 6,
wherein said tobacco material is shredded dried stems.

8. The cellulosic material according to claim 1,
wherein said smoke diluent has a melting point of less than about 95° C.

9. The cellulosic material according to claim 1,
wherein the smoke diluent is one of a water insoluble and a water sparingly soluble liquid.

10. The cellulosic material according to claim 9,
wherein the smoke diluent is at least one of glycerol, triacetin, triethyl citrate, and isopropyl myristate.

11. A method of preparing a cellulosic material having an added smoke diluent retained within its cellular structure and, optionally, on its surface.

12. The method according to claim 11, further comprising the use of a diluent delivery system.

13. The method according to claim 12,
wherein the diluent delivery system involves subjecting the cellulosic material to a treatment comprising at least one of: heat treatment, vacuum treatment, liquid impregnation treatment, steam treatment and vacuum freeze drying, at least one of before and during application of the smoke diluent.

14. The method according to claim 12,
wherein the diluent delivery system involves treating the cellulosic material to substantially reduce its moisture content.

15. The method according to claim 11,
wherein the smoke diluent is included or combined with a vehicle.

16. The method as claimed in claim 15,
wherein the vehicle is water, an alcohol or liquid or gaseous carbon dioxide.

17. The method as claimed in claim 15,
wherein the smoke diluent is in the form of an aqueous solution or emulsion prior to being retained by the cellulosic material.

18. The method as claimed in claim 17,
wherein the aqueous solution or emulsion is prepared by a method comprising high shear mixing.

19. The method as claimed in claim 11,
wherein the smoke diluent is added to the cellular structure using a continuous spray method.

20. The method as claimed in claim 11,
wherein the smoke diluent is added to the cellular structure using a batch mixing method.

21. A smoking article comprising a cellulosic material having at least one smoke diluent within its cellular structure and, optionally, on its surface,
wherein the weight of said smoke diluent is greater than or equal to 5% based on the dried weight of the cellulosic material.

22. The smoking article according to claim 21,
wherein the article is a cigarette.

23. A method of preparing a smoking article comprising mixing a cellulosic material having at least one smoke diluent within its cellular structure and optionally on its surface with other cellulosic materials or smoking article constituents.

* * * * *

UNITED STATES PATENT AND TRADEMARK OFFICE

CERTIFICATE OF CORRECTION

PATENT NO. : 8,758,561 B2
APPLICATION NO. : 13/811249
DATED : June 24, 2014
INVENTOR(S) : David John Dittrich et al.

It is certified that error appears in the above-identified patent and that said Letters Patent is hereby corrected as shown below:

In the Claims

Column 12, line 45, Claim 1, please delete the word "having"

Signed and Sealed this
Twenty-eighth Day of October, 2014

Michelle K. Lee

Michelle K. Lee
*Deputy Director of the United States Patent and Trademark Office*